United States Patent [19]

Duarte

[11] Patent Number: 4,967,661

[45] Date of Patent: Nov. 6, 1990

[54] SHEET TRANSFER MECHANISM FOR PRINTING PRESS

[75] Inventor: Eduardo Duarte, Irving, Tex.

[73] Assignee: Duarte Procuts, Inc., Irving, Tex.

[21] Appl. No.: 191,322

[22] Filed: May 9, 1988

Related U.S. Application Data

[63] Continuation-in-part of Ser. No. 58,892, Jun. 5, 1987, Pat. No. 4,836,104.

[51] Int. Cl.[5] ..... B41F 13/08

[52] U.S. Cl. ..... 101/420; 271/195

[58] Field of Search ..... 101/419, 420, 424.1, 101/416.1; 271/276, 194, 195, 82; 416/187

[56] References Cited

U.S. PATENT DOCUMENTS

| | | | |
|---|---|---|---|
| 866,887 | 9/1907 | Robinson | 416/187 |
| 1,201,788 | 10/1916 | Yetter | 101/420 X |
| 2,730,950 | 1/1956 | Grassi | 101/420 |
| 2,736,106 | 2/1956 | Offen | 101/420 X |
| 3,308,522 | 3/1967 | Miller | 101/420 X |
| 3,542,358 | 11/1970 | Schulmann | 101/420 X |
| 4,242,959 | 1/1981 | Jeschke et al. | 101/420 |
| 4,402,467 | 9/1983 | DeMoore | 101/419 |
| 4,552,069 | 11/1985 | Jahn | 101/420 |
| 4,572,073 | 2/1986 | Mitze et al. | 101/419 X |
| 4,688,784 | 8/1987 | Wirz | 271/195 |
| 4,694,750 | 9/1987 | Greene | 101/420 X |
| 4,722,276 | 2/1988 | Tyler | 101/419 |
| 4,815,379 | 3/1989 | Becker et al. | 101/420 X |
| 4,836,104 | 6/1989 | Duarte | 101/420 |

FOREIGN PATENT DOCUMENTS

| | | | |
|---|---|---|---|
| 261143 | 6/1913 | Fed. Rep. of Germany | 101/420 |
| 3422443 | 12/1985 | Fed. Rep. of Germany . | |

*Primary Examiner*—Clifford D. Crowder

*Attorney, Agent, or Firm*—Crutsinger & Booth

[57] ABSTRACT

A sheet transfer mechanism comprising a gripper bar which engages the leading edge of a freshly printed sheet to move the sheet along a curved path and a sheet guide member having a guide surface formed thereon which has a radius of curvature significantly less than the radius of curvature of the curved path to guide the sheet along the path while the printed surface of the sheet is separated from the guide surface by an air cushion. At least a portion of the guide surface on the guide member is rough to carry a boundary layer of air. The guide surface is positioned relative to a vane to form an air chamber having an air dispensing passage such that rotation of the guide member forces air thorough the chamber and through the dispensing passage in a direction generally perpendicular to the guide surface to assure that the freshly printed surface on the sheet does not contract the trailing edge of the guide surface. Orifices through the guide surface communicate with the air chamber to deliver streams of air through the guide surface.

6 Claims, 8 Drawing Sheets

SHEET TRANSFER MECHANISM FOR PRINTING PRESS

This is a continuation-in-part of my copending application Ser. No. 07/058,892 filed June 5, 1987, entitled "Sheet Transfer Mechanism, " now U.S. Pat. No. 4,836,104 which issued June 6, 1989.

TECHNICAL FIELD

The present invention relates to a method and apparatus for transferring freshly printed sheets between printing stations in a printing press or delivering printed sheets to a stack.

BACKGROUND OF INVENTION

Skeleton wheels and transfer cylinders are conventionally employed in printing presses for conveying freshly printed sheets. Sheets are often "marked" when freshly printed surfaces contact the surface of skeleton wheels and transfer cylinders as a result of smearing the ink or causing ink to be offset onto the transfer cylinder or skeleton wheel and then reapplied to the printed sheet.

U.S. Pat. No. 4,402,267 discloses a Teflon (a registered trademark of E.I. Dupont de Nemours for a tetrafluroethylene material) covered skeleton wheel, to provide an ink repellent coating covered by a loosely supported gauze covering. The surface of the skeleton wheel is described as being ink repellent and polished such that the gauze is free to move slightly over the ink repellent support surface such that a printed sheet is supported and transferred by the skeleton wheel such that the freshly printed sheet is not marred. However, under certain printing conditions ink is transferred to the gauze which must be replaced.

SUMMARY OF INVENTION

The sheet transfer mechanism disclosed herein forms an air cushion adjacent a guide surface such that the direction of travel of the sheet is precisely controlled while the freshly printed surface of the sheet is supported on the cushion of air to prevent offsetting of ink from the sheet to the guide surface. The guide surface is roughed such that a boundary layer of air is carried by the guide surface and is maintained between the freshly printed surface of the sheet and the guide surface. The roughened guide surface may be formed by detachably securing strips or dots of sandpaper-like material to a curved surface on the guide member. In the event that ink accumulates on the roughened surface, under extreme printing conditions, the strips of sandpaper are replaceable.

The sheet guide member comprises an arcuate sheet guide member and a vane secured to a central spoke rotatable about a sheet transfer axis. The radius of curvature of the sheet guide surface on the guide member is significantly less than the radius of curvature of the path along which a gripper carries the leading edge of the sheet.

The guide member is provided with a vane having a trailing edge positioned relative to the trailing edge of the guide surface to form an air dispensing passage through which air is dispensed, as the guide member rotates, to assure that the trailing edge of the guide surface is not engaged by the printed surface on the sheet.

DESCRIPTION OF DRAWING

Drawings of four embodiments of the invention are annexed hereto so that the invention may be better and more fully understood, in which.

Numeral references are employed to designate like parts throughout the various figures of the drawing.

DESCRIPTION OF A PREFERRED EMBODIMENT

Figure 6:
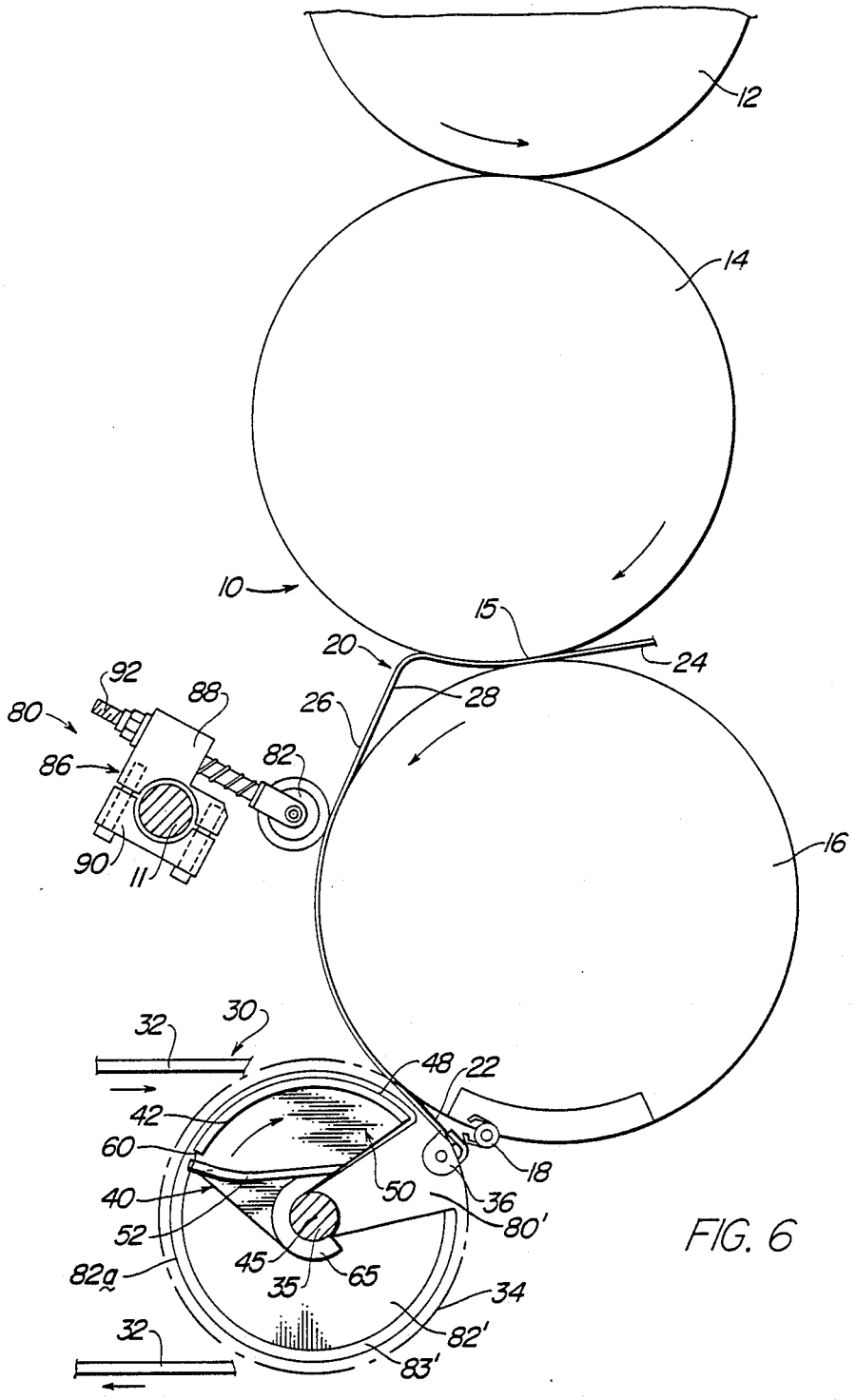
FIG. 6 is a diagrammatic view of the sheet guide member mounted in a sheet transfer mechanism in a delivery station of a printing press.

Referring to FIG. 6 of the drawing, the numeral 10 generally designates a printing press. Printing press 10 may assume any desired configuration. However, the illustrated embodiment is a lithographic sheet-fed printing press comprising a plate cylinder 12, a blanket cylinder 14 and an impression cylinder 16. Impression cylinder 16 is equipped with a sheet gripper 18 which engages the leading edge 22 of a sheet 20 for moving the sheet through a printing nip 15 between blanket cylinder 14 and impression cylinder 16.

Ink is applied to image areas of a printing plate on plate cylinder 12 and is transferred to the surface of a blanket carried by blanket cylinder 14. The image is transferred from the blanket to the printed surface 26 of sheet 20. The tack of the ink on blanket cylinder 14 causes the printed surface 26 of sheet 20 to stick to the surface of blanket cylinder 14 such that sheet 20 must be pulled away from the surface on blanket cylinder 14. The trailing portion 24 of the sheet is drawn through the printing nip 15 by rotation of the cylinders.

Plate cylinder 12, blanket cylinder 14 and impression cylinder 16 are of conventional design and well known to those skilled in the lithographic printing art.

The sheet transfer mechanism, generally designated by the numeral 30 in FIG. 6 of the drawing, may assume a variety of configurations. The illustrated embodiment of sheet transfer mechanism 30 comprises a pair of chains 32 carrying gripper bars 36 which are driven by sprockets 34 mounted on a shaft 35 which is rotatable about an axis 45. Conventional skeleton wheels and transfer cylinders heretofore devised have been mounted on shaft 35 and have had a radius of curvature substantially equal to the pitch line of gear 34. The freshly printed surface 26 on sheet 20 physically contacted surfaces on the skeleton wheels and transfer cylinders which caused the freshly printed ink to be applied to the skeleton wheel or transfer cylinder.

The pitch diameter of sprocket 34 is illustrated in dashed outline in FIG. 6.

A sheet guide member generally designated by the numeral 40 in FIG. 6 of the drawing is mounted on shaft 35 and rotates about axis 45.

Figure 1:
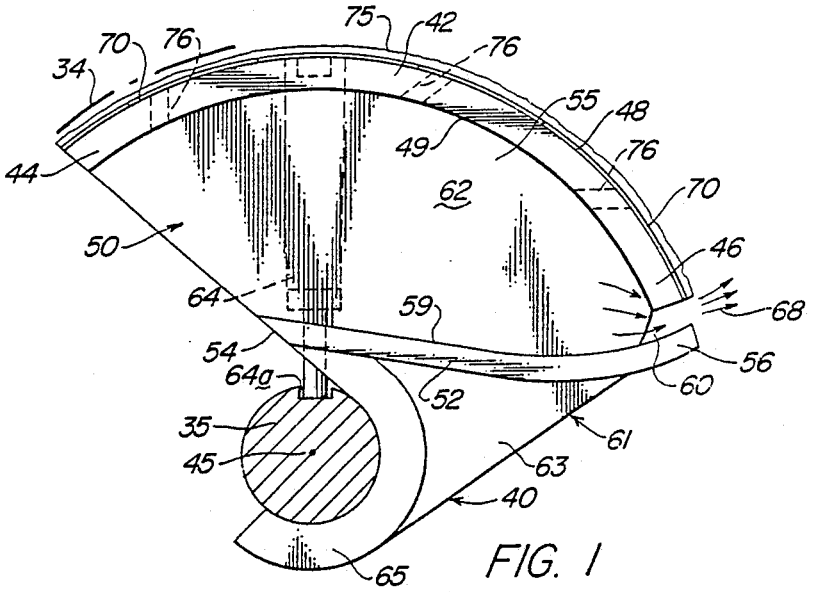
FIG. 1 is a side elevational view of a sheet guide member.
Figure 2:
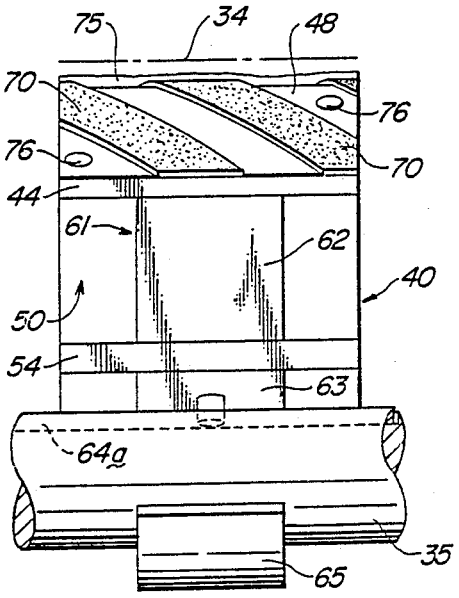
FIG. 2 is a front elevational view thereof.
Figure 3:
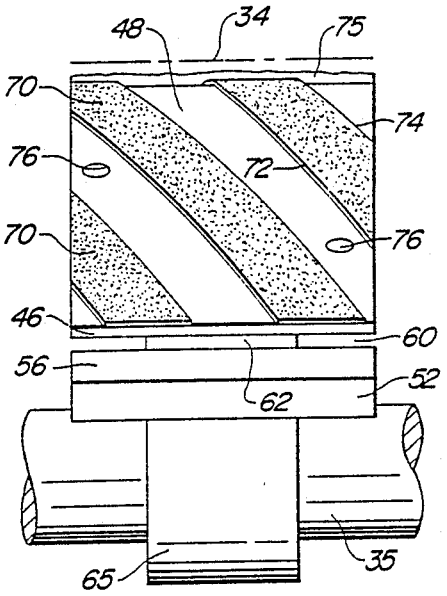
FIG. 3 is a rear elevational view thereof.

Referring to FIGS. 1, 2 and 3 of the drawing, sheet guide member 40 comprises an arcuate guide segment 42 and a vane 52 secured to a spoke 61, an upper portion 62 of the spoke extending between guide segment 42 and vane 52. A lower portion 63 of the spoke extends from vane 52 and has a hub 65 formed on the lower end thereof. As best illustrated in FIG. 1 of the drawing, hub 65 extends around slightly less than 180 degrees of the circumference of shaft 35 and is locked onto shaft 35 by a set screw 64.

The arcuate guide segment 42 has a leading edge 44 and a trailing edge 46 with a curved outer guide surface 48 extending therebetween. Vane 52 has a leading edge 54 and a trailing edge 56. As best illustrated in FIG. 1 of the drawing, guide segment 42 is spaced from vane 52, forming a chamber 55 between inner surface 49 on guide segment 42 and inner wall 59 on vane 52. The upper portion 62 of the spoke extends between central portions of guide segment 42 and vane 52, as best illustrated in FIG. 2, to form spaced entrance openings 50 into air chamber 55. Trailing edges 46 and 56 of guide segment 42 and vane 52, respectively, are closely spaced to form an air dispensing passage 60 therebetween. The cross-section of chamber 55 diminishes from entrance opening 50 toward air dispensing passage 60 such that a stream 68 of high velocity air flows through dispensing passage 60 to impinge against the freshly printed surface 26 on sheet 20 to assure that trailing edges 46 and 56 are separated from printed surface 26 of sheet 20. Vane 52 is curved and shaped adjacent trailing edge 56 to direct air stream 68 generally radially of and perpendicular to guide surface 48.

Guide surface 48 on the arcuate guide segment 42 is roughened to cause a boundary layer 75 of air to be carried adjacent guide surface 48 to provide a cushion of air to maintain the printed surface 26 on sheet 20 separated from guide surface 48 preventing physical contact therebetween.

Figure 4:
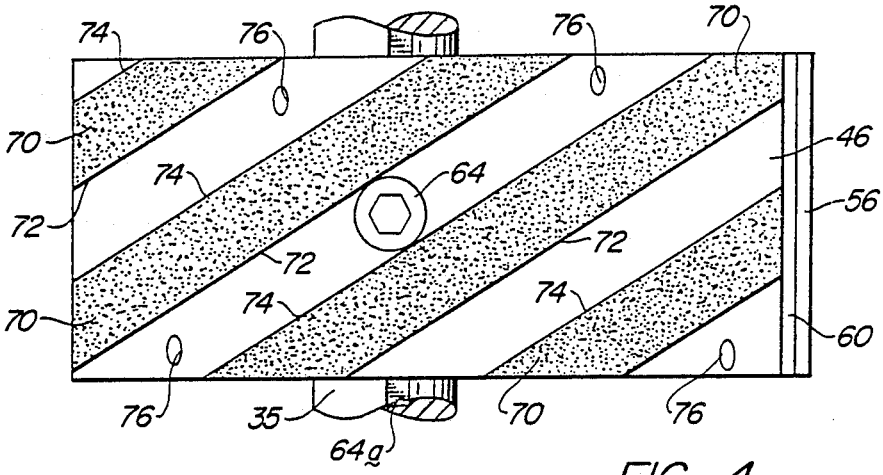
FIG. 4 is a top plan view thereof.
Figure 5:
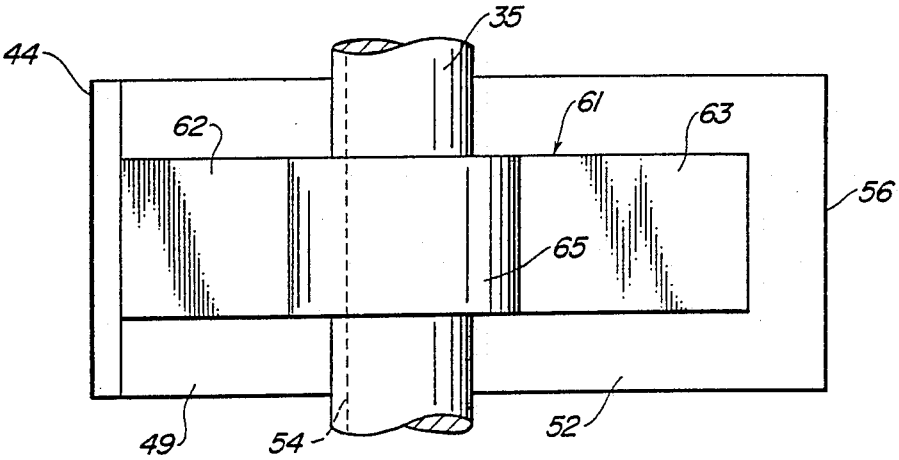
FIG. 5 is a bottom view.

In the first illustrated embodiment, strips 70 of sandpaper-like material are bonded to guide surface 48. Strips 70 preferably do not cover the entire guide surface 48. As best illustrated in FIGS. 3 and 4 of the drawing, edges 72 and 74 of each strip 70 are spaced apart leaving a portion of guide surface 48 therebetween exposed. Strips 70 are angularly disposed across guide surface 48 and substantially skewed relative to the path of rotation traveled by guide surface 48.

Orifices 76 extend through guide segment 42 for delivering streams of air from air chamber 55 to impinge against the surface of sheet 26.

As best illustrated in FIGS. 1 and 4 of the drawing, set screw 64 preferably has an enlarged upper portion having threads on the outer surface thereof which engage an internally threaded aperture extending through arcuate guide segment 42 and the upper portion 62 of the spoke 61 and has a non-threaded reduced diameter portion extending through a central portion of vane 52 which engages shaft 35. It should be readily apparent that set screw 64 can be loosened to permit adjustment of sheet guide member 40 longitudinally of shaft 35. When sheet guide member 40 is in the desired position, set screw 64 can be tightened preventing relative movement between guide member 40 and shaft 35. The end of set screw 64 extends into a keyway **64*a* in shaft 35 to angularly position the sheet guide member 40 relative to gripper bars 36**.

Sheet guide member 40 is preferably a replacement part for skeleton wheels or transfer cylinders employed in conventional printing presses. In conventional printing presses, the spacing between gripper bars 36 along chains 32 in a delivery station is generally approximately equal to the length of the circumference of impression cylinder 16. In some printing presses, skeleton wheels are provided with two or more gaps or cut-out portions through which gripper bars 36 extend as the skeleton wheel rotates. Sheet guide member 40 will be formed with two guide segments 42 spaced apart to provide two guide surfaces to accommodate gripper bars on these presses.

The mounting structure for skeleton wheels on shaft 35 of different manufacturers varies. It will be appreciated that connectors other than set screw 64 may be employed for securing hub 65 to shaft 35 and that the configuration of hub 65 will vary to accommodate different shaft designs.

Figure 7:
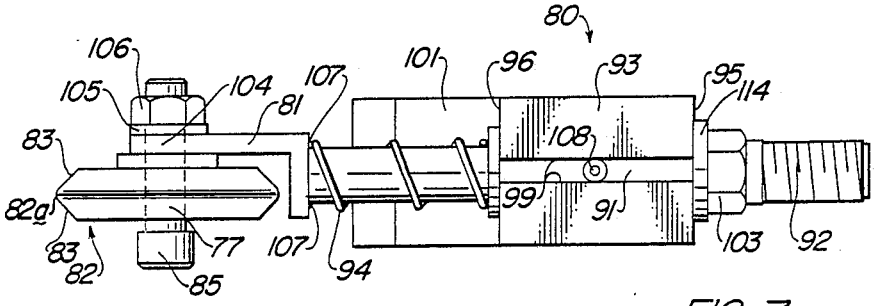
FIG. 7 is a top plan view of a sheet guide assembly.
Figure 8:
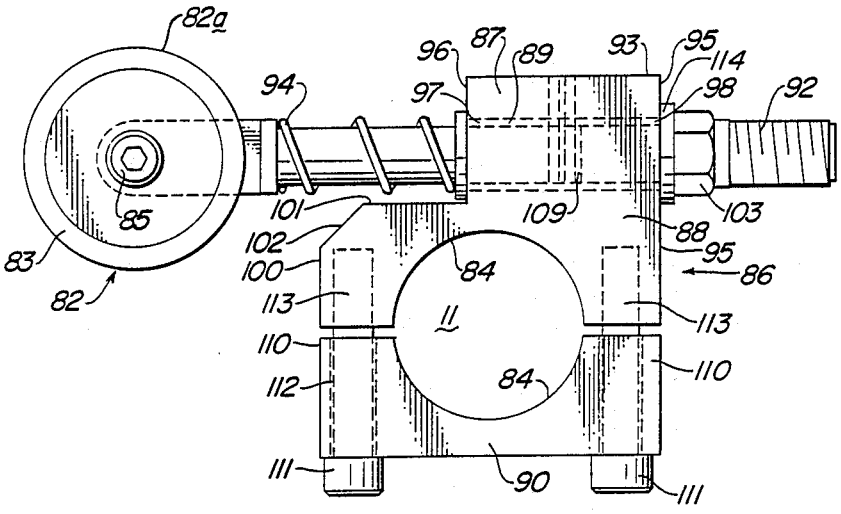
FIG. 8 is a side elevation view of the side guide assembly.

Turning to FIGS. 6–8 of the drawing, there is illustrated a side guide assembly generally designated by the numeral 80. Side guide assembly 80, comprises a wheel 82, a bracket 86, a shaft 92, and a spring 94 adapted for guiding the trailing edge 24 of a freshly printed sheet 20 in printing press 10.

As best shown in FIG. 6, side guide assembly 80 is preferably secured around a tubular support member 11 such as a conventional tie bar extending between the side frames (not shown) of printing press 10. Side guide assembly 80 is preferably positioned adjacent to impression cylinder 16 near the edge of the sheet.

Turning to FIGS. 7–8 of the drawing, bracket 86 has a body segment 88 and a mating member 90 constructed and arranged to form a split block having a central opening bounded by surfaces 84. The block segments 88 and 90 are secured together by screws 111. Body segment 88 has an upper portion 87 having a central bore 89, a rear wall 95, a front wall 96, and a substantially flat top surface 93. Central bore 89 extends through front wall 96 and rear wall 95 forming openings 97 and 98 in front wall 96 and rear wall 95, respectively.

A central keyway slot 91 is formed in top surface 93 and extends between front wall 96 and rear wall 95 in parallel relation to central bore 89. As best shown in FIG. 7, keyway 91, having parallel opposing sidewalls 99 perpendicularly disposed relative to top surface 93 extends between top surface 93 and central bore 89 to form a passage between top surface 93 and central bore 89. Front wall 96 and rear wall 95 are parallel to each other and perpendicularly disposed relative to top surface 93.

The lower portion of body segment 88 is substantially enlarged relative to upper portion 87, extending between rear wall 95 and forward wall 100 and having a semicircular 180 degree hub 84 centrally formed therein. Forward wall 100 is perpendicularly disposed relative to top surface 93 and parallel relative to front wall 96. Support surface 101 is parallel with top surface 93 and extends from front wall 96 to clearance shoulder 102. Clearance shoulder 102 is angularly inclined relative to support surface 101 and forward wall 100 and extends therebetween.

Shaft 92 having threaded outer surface is slidably positioned in central bore 89. Nut 103 is threadably engaged with the outer surface of shaft 92 and positioned adjacent rear wall 95.

Wheel 82 having a substantially circular configuration and a central bore 77 therethrough is rotatably engaged around socket head screw 85. The peripheral edge of wheel 82 is tapered having inclined opposing shoulders 83 arranged to form a narrow rounded support surface 82*a*. Wheel 82 is secured to extension bracket 81 having a bore 104 by the cooperative engagement of socket head screw 85, washer 105 and nut 106. Socket head screw 85 is disposed such that the threaded portion of screw 85 extends through the central bore of wheel 82, the central bore of lock washer 105, the bore 104 of extension bracket 81, and threadably engages nut 106. Wheel 82 is thereby precluded from excessive lateral movement relative to screw 85, wheel 82 being secured between the head portion of screw 85 and bracket 81. Extension bracket 81 is positioned between washer 105 and wheel 83.

The opposite end of extension bracket 81 is secured to one end of shaft 92. Extension bracket 81 is provided with outwardly extending stop shoulders 107 which are positioned adjacent to the end of shaft 92 and perpendicularly disposed relative to the threaded outer surface of shaft 92. Spring 94 is positioned around shaft 92 and secured in compressed tension between front wall 96 of body segment 88 and stop shoulders 107 of extension member 81.

Shaft 92 is provided with a cross bore 109 perpendicularly disposed relative to top surface 93. Roll pin 108 is positioned inside cross bore 109 and a portion of roll pin 108 extends upwardly into keyway 91. Roll pin 108 is positioned to move linearly between opposing sidewalls 99 of keyway 91 to prevent rotation of shaft 92 relative to bracket 86.

Mating member 90 has a centrally disposed semicircular 180 degree hub 84 intermediate two anchor portions 110. Mating member 90 is securable to body segment 88 by bolts 111 disposed in bores 112 in anchor portions 110. Bolts 111 cooperatively engage threaded bores 113 in body segment 88 juxtaposing hubs 84 to grippingly engage tubular member 11.

As shown in FIG. 6, side guide assembly 80 is positioned such that wheel 82 is held in pressure relation to impression cylinder 16 for guiding the trailing edge 24 of a freshly printed sheet 26. It will be apparent to those skilled in the art that side guide assembly 80 may be positioned at any given point along tubular member 11 for urging wheel 82 to contact only "gutters" or other non-image areas of printed sheet 26. It will also be apparent that the degree of pressure exerted upon the freshly printed sheet 26 by wheel 82 may be adjusted by adjusting the positioning of nut 103 along shaft 92, thereby increasing or decreasing the compression of spring 94. The point of contact of wheel 82 may be adjusted circumferentially of cylinder 16 by rotating block segments 88 and 90 relative to tie bar 11.

Figure 14:
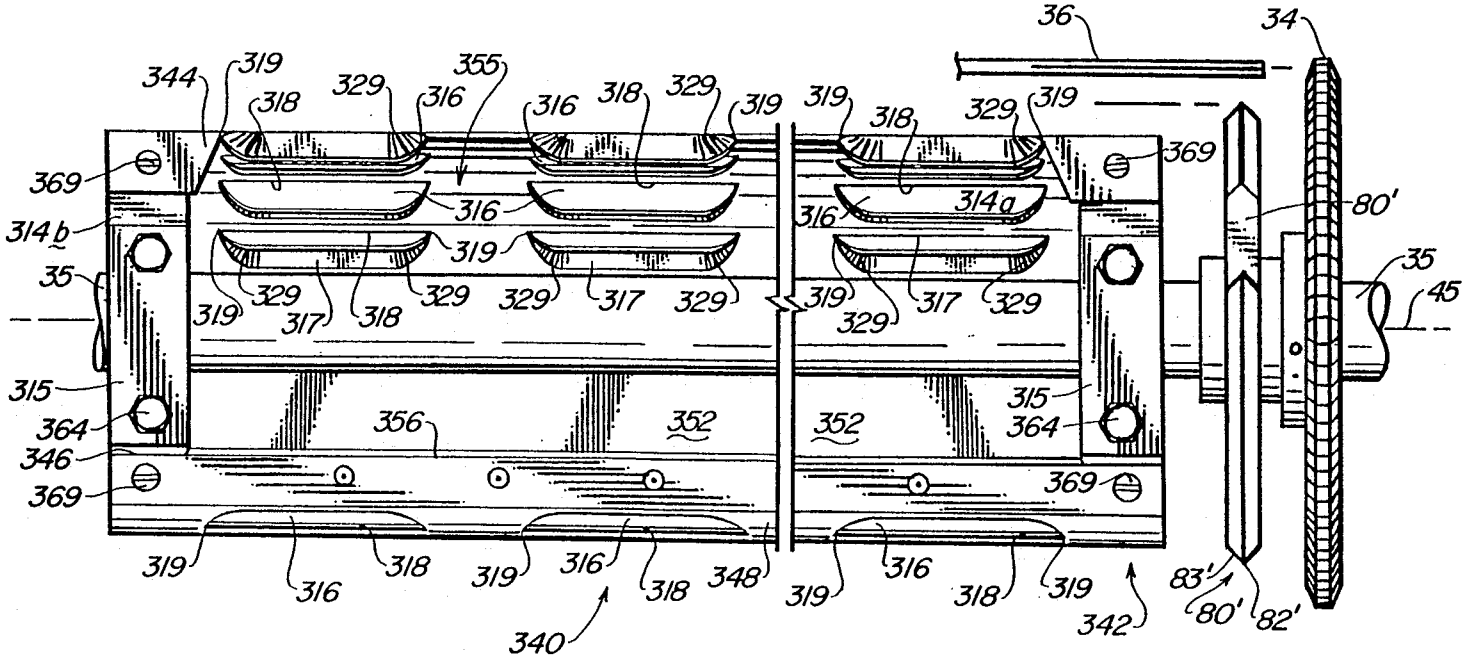
FIG. 14 is a side elevational view of a fourth embodiment of the sheet guide member.

As best illustrated in FIGS. 6 and 14 of the drawing, side guide wheels 82′ may be mounted at two or more locations along shaft 35 to assure that the trailing portion 24 of sheet 20 does not engage shaft 35 as a result of gravitational force when the trailing edge of sheet 20 is pulled from the surface of blanket cylinder 14. Wheel 82′ preferably has a major diameter which is greater than the pitch diameter of sprockets 34 but greater than the major diameter of arcuate surface 48 of sheet guide member 40. Each wheel 82′ has a gap 80′ formed to permit passage of gripper bar 36 and has beveled or tapered peripheral edge 83′ forming a narrow support surface 82*a*′.

It should be appreciated that guide assembly 80 and guide wheel 82′ may be employed separately or in combination depending upon the sheet weight and stiffness.

DESCRIPTION OF A SECOND EMBODIMENT

Figure 9:
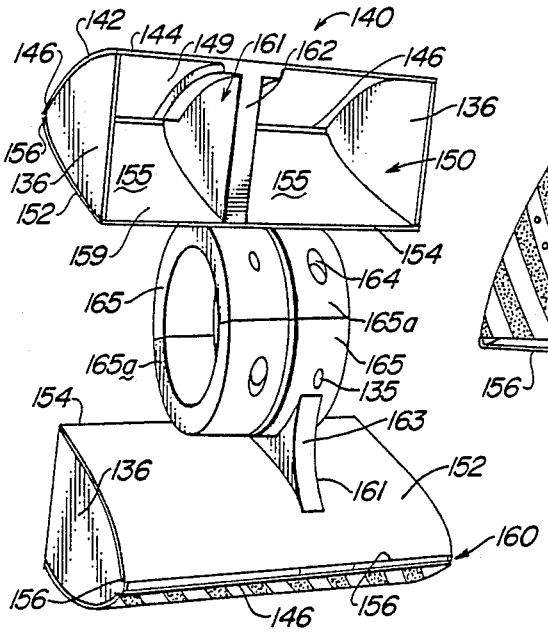
FIG. 9 is a front perspective view of a second embodiment of the sheet guide member.
Figure 10:
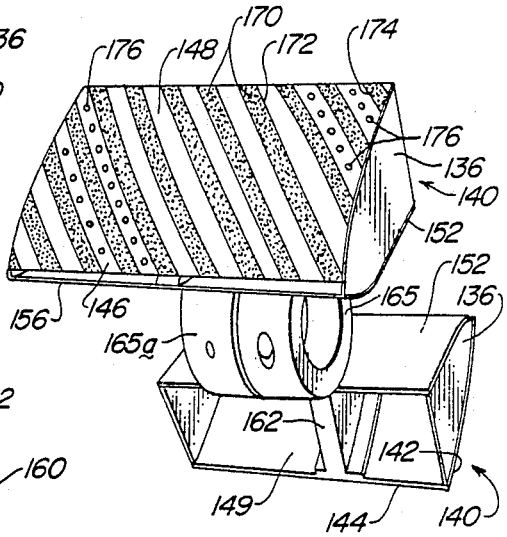
FIG. 10 is a rear perspective view of the second embodiment thereof.
Figure 11:
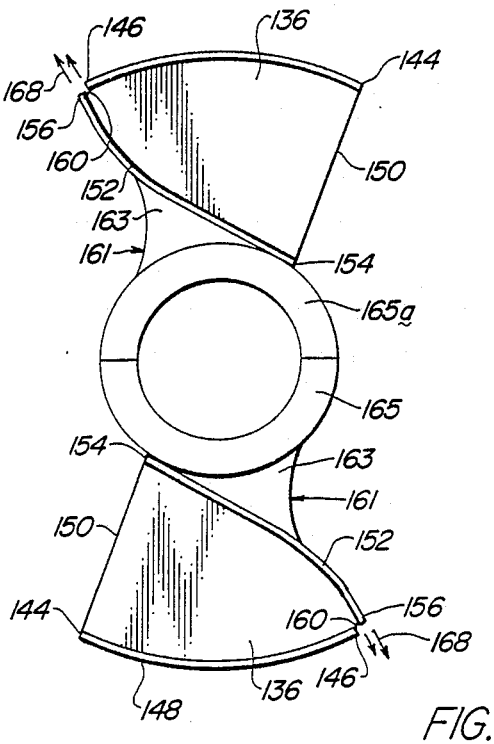
FIG. 11 is a side elevational view of the second embodiment thereof.

A second embodiment of the sheet guide member is illustrated in FIGS. 9–11 of the drawing wherein the sheet guide member is generally designated by the numeral 140. According to this embodiment of the invention, sheet guide member 140 comprises arcuate guide segment 142 and a vane 152 secured to a spoke 161, an upper portion 162 of the spoke 161 extending between the guide segment 142 and vane 152. A lower portion 163 of the spoke 161 extends from vane 152 and has a hub segment 165 formed on the lower end thereof.

The arcuate guide segment 142 has a leading edge 144 and a trailing edge 146 with a curved outer guide surface 148 therebetween. Vane 152 has a leading edge 154 and a trailing edge 156. Guide segment 142 is spaced from vane 152, forming a chamber 155 between inner surface 149 on guide segment 142 and inner wall 159 on vane 152. End portions 136 extend between vane 152 and guide segment 142 at opposite ends of sheet guide member 140, end portions 136 being perpendicularly disposed relative to vane 152 and guide segment 142. End portions 136 extend between leading edges 144 and 154 and trailing edges 146 and 156 of the guide segment 142 and vane 152, respectively, enclosing the ends of guide member 140. Trailing edges 146 and 156 of guide segment 142 and vane 152, respectively, are closely spaced to form an air dispensing passage 160 therebetween. The cross-section of chamber 155 diminishes from entrance opening 150 toward air dispensing passage 160 such that a stream 168 of high velocity air flows through air dispensing passage 160 to impinge against the freshly printed surface 26 of sheet 20 to assure that trailing edges 146 and 156 are separated from printed surface 26 of sheet 20. Vane 152 is curved and shaped adjacent trailing edge 156 to direct air stream 168 generally radially of and perpendicular to guide surface 148.

As best illustrated in FIGS. 9 and 11 of the drawing, hub segment 165 extends around approximately 180 degrees of the circumference of shaft 35 and is detachably secured to a corresponding mating hub cap segment 165*a* by caps screws 164, said mating hub cap segment 165*a* extending approximately 180 degrees around the circumference of shaft 35 for grippingly engaging substantially the entire circumference of shaft 35 and securing sheet guide member 140 to shaft 35. At least one of the hub segment 165 or cap segment 165*a* may be provided with an anti-rotation pin (not shown) to extend into a keyway of the shaft 35 upon which the sheet guide 140 is mounted. It will of course be appreciated that the cooperative engagement of hub cap segment 165*a* and mating hub segment 165 around shaft 35 can be accomplished using a variety of structural configurations without departing from the scope of the invention.

In the illustrated second embodiment, strips 170 of sandpaper-like material are bonded to guide surface 148.

Strips 170 preferably do not cover the entire guide surface 148. As best illustrated in FIGS. 9 and 10 of the drawing, edges 172 and 174 of each strip are spaced apart having a portion of guide surface 148 exposed. Strips 170 are in non-parallel alignment relative to the direction of rotation of guide member 140 around shaft 35.

Orifices 176 extend through guide segment 142 for delivering streams of air from air chamber 155 to impinge against the surface of sheet 20.

Cap screws 164 preferably have an enlarged upper portion having threads on the outer surfaces thereof which engage internally threaded apertures 135 extending through hub segment 165 and mating hub cap segment 165*a* for securing guide member 140 to shaft 35, hub segment 165 and mating hub cap segment 165*a* being fitted around the circumference of shaft 35 in tight gripping frictional engagement. It should be readily apparent that cap screws 164 can be loosened to permit adjustment of sheet guide member 140 both longitudinally and circumferentially on shaft 35. When sheet guide member 140 is in the desired position, cap screws 164 can be tightened preventing relative movement between guide member 140 and shaft 35. It is readily apparent that a key may be formed in some press designs to extend from the inner wall of hub segment 165 or the inner wall of mating hub cap segment 165*a* for extending into a keyway in shaft 35 to angularly position the sheet guide member 140 relative to gripper bars 36.

Sheet guide member 140 is preferably a replacement part for skeleton wheels or transfer cylinders employed in conventional printing presses. In conventional printing presses, the spacing between gripper bars 36 along chains 32 in a delivery station is generally approximately equal to the length of the circumference of impression cylinder 16. In some printing presses, skeleton wheels are provided with two or more gaps or cut-out portions through which gripper bars extend as the skeleton wheel rotates. As best illustrated in FIG. 9, two sheet guide members 140 may be secured to shaft 35 to provide two guide segments 142 spaced apart to provide two guide surfaces to accommodate gripper bars on these presses.

As best shown in FIGS. 9–10, when a plurality of individual guide segments traveling identical arcuate paths around shaft 35 are deemed desirable, spoke 161 and hub segment 165 may be non-centrally positioned between end portions 136 for allowing two or more individual guide members to be positioned adjacent each other in such a manner as to allow end portions 136 of each guide member 140 to travel identical arcuate paths.

The mounting structure for skeleton wheels on shaft 35 of different manufacturers varies. It will be appreciated that connectors other than cap screws 64 may be employed for securing hub segment 165 to shaft 35 and that the configuration of hub segment 165 will vary to accommodate different shaft designs.

The radial distance from axis 45 about which the guide member 140 rotates to the outer surface of sandpaper-like material 170 on guide surface 148 is less than the pitch diameter of sprocket 34 in an amount significantly greater than the thickness of the sheet 20 of paper, for example approximately $\frac{1}{4}''$ to $\frac{1}{2}''$ or more. The boundary layer 175 of air carried adjacent the roughened guide surface 148 on arcuate guide segment 142 of sheet guide member 140 forms a cushion of air which flexes and supports sheet 20 to cause it to move along the arcuate path generally corresponding to the pitch line of sprocket 34 while separating the freshly printed surface 26 of sheet 20 from guide surface 148.

The width of arcuate guide segment 142 and vane 152 is preferably approximately 25% of the sheet 20 and the length of arcuate guide segment 142 is preferably less than about 30% of the maximum sheet length.

The printed surface 26 of sheet 20 tends to stick to the surface of blanket cylinder 14 at locations corresponding to the image carried on blanket cylinder 14. Thus, if sheet 20 is being printed adjacent the trailing edge 24 thereof, the trailing edge of sheet 20 must be pulled from the surface of blanket cylinder 14 by gripper bar 36. As gripper bar 36 rotates downwardly from the position illustrated in FIG. 6 of the drawing to a position substantially vertically below the axis 45 of shaft 35, the freshly printed surface 26 of sheet 20 will be drawn toward guide surface 148 and particularly toward the trailing edge 146 of arcuate guide segment 142 of sheet guide member 140. Air stream 168 flowing through air dispensing passage 160 impinges against the printed surface 26 of sheet 20 to pneumatically separate the sheet from the trailing edge 146 of guide surface 148 and the trailing edge 156 of vane 152.

From the foregoing it should be readily apparent that the freshly printed surface 26 of sheet 20 is aerodynamically supported by air cushion 175 and is pneumatically urged by air stream 168 to control the path along which sheet 20 travels until after the trailing edge 24 of sheet 20 has passed through printing nip 15 and has been pulled from the surface of blanket cylinder 14.

It should be readily apparent that sheet guide member 140 may assume other and different configurations without departing from the basic concept of the invention and that one or more guide members 140 may be used on shaft 35 for some press applications.

DESCRIPTION OF THIRD EMBODIMENT

Figure 12:
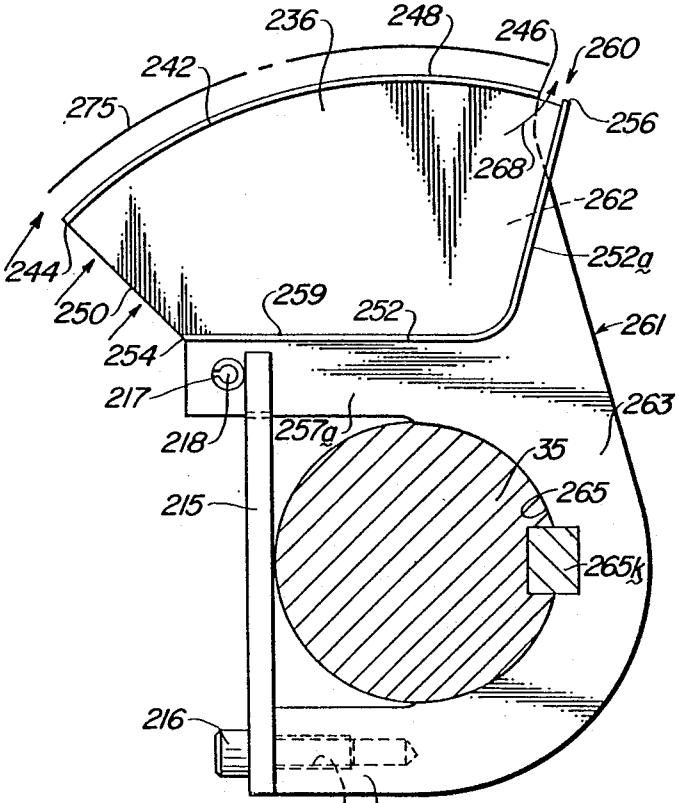
FIG. 12 is a side elevational view of a third embodiment of the sheet guide member.
Figure 13:
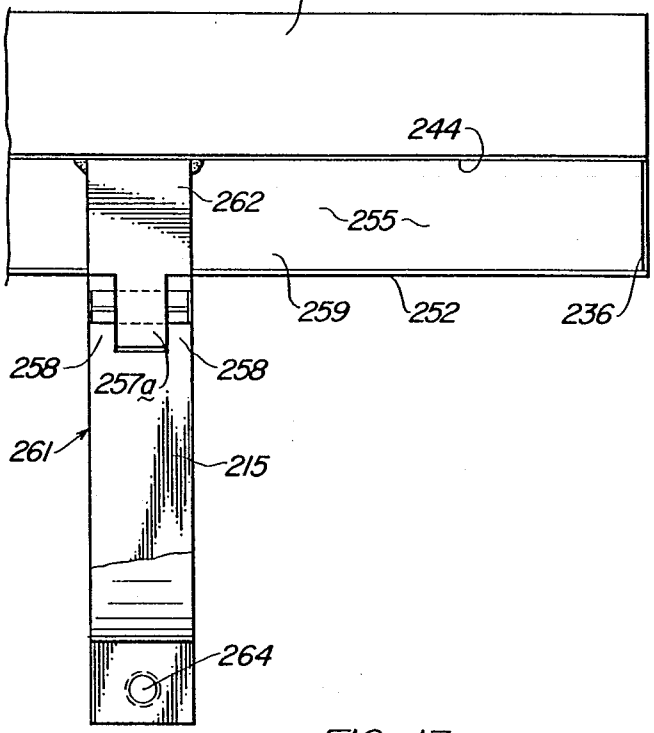
FIG. 13 is a fragmentary front elevational view of the third embodiment.

FIGS. 12 and 13 illustrate a third embodiment of the present invention wherein a hub segment 265 extends approximately 180 degrees around shaft 35 and has projections 257*a* and 257*b* formed thereon and mating member 265*a* comprising a lock down bar 215 secured by a cap screw 216 and a roll key 217.

The arcuate guide segment 242 has a leading edge 244 and a trailing edge 246 with a curved outer guide surface 248 therebetween. Vane 252 has a leading edge 254 and a trailing edge 256. As best illustrated in FIG. 12 of the drawing, guide segment 242 is spaced from vane 252, forming a chamber 255 between inner surface 249 on guide segment 242 and inner wall 259 on vane 252. End portions 236 extend between vane 252 and guide segment 242 at opposite ends of sheet guide member 240, end portions 236 being perpendicularly disposed relative to vane 252 and guide segment 242. End portions 236 extend between leading edges 244 and 254 and trailing edges 246 and 256 of the guide segment 242 and vane 252, respectively, enclosing the ends of guide member 240. Trailing edges 246 and 256 of guide segment 242 and vane 252, respectively, are closely spaced to form an air dispensing passage 260 therebetween. The cross-section of chamber 255 diminishes from entrance opening 250 toward air dispensing passage 260 such that a stream 268 of high velocity air flows through air dispensing passage 260 to impinge against the freshly printed surface 26 of sheet 20 to assure that trailing edges 246 and 256 are separated from printed surface 26 of sheet 20. Vane 252 is curved and the rear portion 252*a* is shaped adjacent trailing edge 256 to direct air stream 268 generally radially of and perpendicular to guide surface 248.

Projection 257*a* is located adjacent vane 252 along lower portion 263 of spoke 261 and has a cross bore 218 in which a roll key 217 is positioned. Roll key 217 is substantially longer than the width of projection 257*a* such that a portion of roll key 217 extends outwardly from each side of projection 257*a*.

Lock down bar 215 comprises a substantially flat bar having anchor projections 258 being spaced apart to permit anchor projections 258 to be fitted around projection 257*a* and abut the end portions of roll key 217 on each side of projection 257*a*. A bore 264 is provided adjacent the opposite end of lock down bar 215, said bore corresponding to a threaded bore 235 in projection 257*b*. Cap screw 216 cooperatively engages bore 264 and threaded bore 235 for detachably securing lock down bar 215 in hub 265 in tight gripping engagement around shaft 35.

As illustrated in FIG. 12, a key 265*k* extends into keyways in shaft 35 and hub 265 to prevent relative movement of hub 265 and shaft 35 when lockdown bar 215 is secured in the illustrated position.

Guide surface 248 on the arcuate guide segment 242 may be roughened and orificed as hereinbefore explained in the description of the first and second embodiments to cause a boundary layer 275 of air to be carried adjacent guide surface 248 to provide a cushion of air to maintain the printed surface 26 on sheet 20 separated from guide surface 48 preventing physical contact therebetween.

DESCRIPTION OF A FOURTH EMBODIMENT

Figure 15:
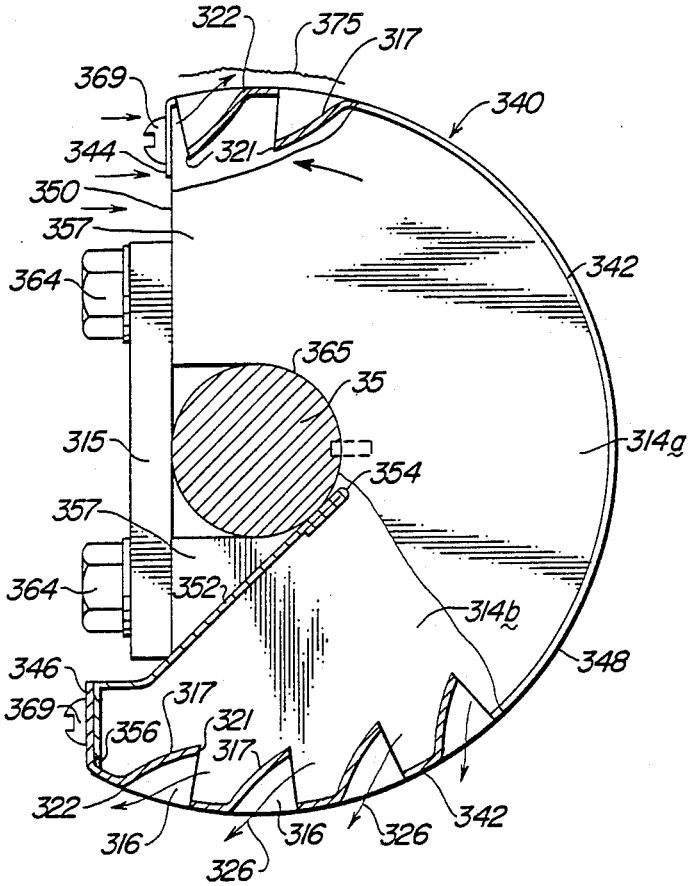
FIG. 15 is an end view of the fourth embodiment, parts being broken away to more clearly illustrate details of construction.

Referring to FIGS. 14–15 of the drawing, a fourth embodiment of the sheet guide number is generally designated as by the numeral 340. Sheet guide member 340 comprises arcuate guide segment 342, and a vane 352 secured by screws 369 between a pair of spaced apart end plates 314*a* and 314*b*. A central portion of each end plate 314*a* and 314*b* has a hub 365 formed therein. As best illustrated in FIG. 15 of the drawing, hub 365 extends around approximately 180 degrees of the circumference of shaft 35 and has projections 357 formed thereon and is detachably secured to a corresponding locking member 315 by cap screws 364, said locking member 315 being substantially flat and adapted for tightly engaging shaft 35 and hub 365 and preventing relative movement therebetween.

The arcuate guide segment 342 has a leading edge 344 and a trailing edge 346 with a curved outer guide surface 348 therebetween. Vane 352 has a leading edge 354 and a trailing edge 356. As best illustrated in FIG. 15 of the drawing, guide segment 342 is spaced from vane 352 forming a chamber 355 between inner surface 349 on guide segment 342 and vane 352. End plates 314*a* and 314*b* extend between vane 352 and guide segment 342 at opposite ends of sheet guide member 340, end portions 314*a* and 314*b* being perpendicularly disposed relative to vane 352 and guide segment 342. End plates 314*a* and 314*b* extend between leading edges 344 and 354 and trailing edges 346 and 356 of the guide segment 342 and vane 352 respectively, enclosing the ends of guide member 340. Trailing edges 346 and 356 of guide segment 342 and vane 352 respectively overlap to form a rear wall substantially enclosing air chamber 355 adjacent trailing edges 346 and 356. Trailing edges 346 and 356 being secured to end plates 314*a* and 314*b* by screws 369.

Guide surface 348 on the arcuate guide segment 342 is vented to dispense streams of air 326 adjacent guide surface 348 to provide a cushion of air to maintain the printed surface 26 on sheet 20 separate from guide surface 348 preventing physical contact therebetween.

In the illustrated fourth embodiment, guide surface 348 is provided with an array of longitudinally and circumferentially disposed vents 316 for delivering a plurality of streams of air 326 from air chamber 355 to impinge against the surface of sheet 20. Vents 316 are formed by series of spaced apart axial incisions 318 made in guide surface 348 intermediate the axial ends of guide surface 348. Axial incisions 318 are perpendicularly disposed relative to end plates 314. The terminal ends 319 of axial incisions 318 being spaced apart relative to the axial ends of guide surface 348.

The portion of guide surface 348 adjacent axial incision 318 is displaced from the plane occupied by guide surface 348 forming impeller blades 317 having a leading edge 321 and a trailing edge 322. Impeller blades are disposed at an angle of approximately 45 degrees relative to guide surface 348. The leading edge 321 of each impeller blade 317 is more proximate the leading edge 344 of guide surface 348 than the corresponding trailing edge 322 of each impeller blade 317. The displacement of impeller blades 317 from the plane of guide surface 348 deforms and stretches a portion of guide surface 348 adjacent the terminal ends of axial incisions 318 such that curved webs 329 are formed between the terminal ends of axial incisions 318 and impeller blades 317.

Support panels 322 are formed between vents 316 on arcuate guide surface 348. Guide surface 348 may be manufactured from a flat sheet of metal or other suitable material with vents 316 and impeller blades 317 being formed along the outer surface of guide segment 342 by means of a punch press for perforating and shaping arcuate guide surface and subsequently rolled to the semicircular configuration correspondent to end mounts 314.

Sheet guide member 340 is preferably a replacement part for skeleton wheels or transfer cylinders employed in conventional printing presses. In conventional printing presses, the spacing between gripper bars 36 along chains 32 in a delivery station is generally approximately equal to the length of the circumference of impression cylinder 16. In some printing presses, skeleton wheels are provided with two or more gaps or cut-out portions through which gripper bars 36 extend as the skeleton wheel rotates. Sheet guide member 340 is provided with a cut out section 325 to accommodate gripper bars on these presses.

The mounting structure for skeleton wheels on shaft 35 of different manufacturers varies. It will be appreciated that connectors other than cap screws 364 may be employed for securing hub 365 to shaft 35 and that the configuration of hub 365 will vary to accommodate different shaft designs.

The radial distance from axis 45 about which the guide member 340 rotates to the outer surface of arcuate guide surface 348 is less than the pitch diameter of sprocket 34 in an amount significantly greater than the thickness of the sheet 20 of paper, for example approximately $\frac{1}{4}''$ to $\frac{1}{2}''$ or more. The air dispensed through vents 316 on arcuate guide segment 342 of sheet guide member 340 forms a cushion of air which flexes and supports sheet 20 to cause it to move along the arcuate path generally corresponding to the pitch line of sprocket 34 while separating the freshly printed surface 26 of sheet 20 from guide surface 348.

The axial length of arcuate guide segment 342 and vane 52 is preferably approximately equal to the width of the sheet 20 and the circumferential length is generally greater than 210 degrees.

From the foregoing it should be readily apparent that this preferred embodiment of the sheet guide member functions as a cylindrical impeller which when rotated about axis 45 scoops air into entrance opening 350 and dispenses streams of air 326 through vents 316 forming a cushion of air 375 adjacent guide surface 348. The freshly printed surface 26 of sheet 20 is aerodynamically supported by air cushion 375 and is pneumatically urged by air streams 326 to control the path along which sheet 20 travels.

I claim:

1. A sheet transfer mechanism comprising: sheet gripper means; means to move the gripper means along a curved path about an axis; a sheet guide member rotatable about said axis; an arcuate guide surface on said guide member, said arcuate guide surface having a leading edge and having a portion deflected toward said axis to form impeller means adjacent a vent opening; means secured to said guide surface to form a chamber, said leading edge of said arcuate guide surface bounding an entrance passage into said chamber and being arranged to collect and move air into said chamber as said sheet guide member rotates; and means rotating said sheet guide member in synchronized relation to said gripper means to guide a printed sheet along said path, said vent opening being positioned to form a stream of air directed toward the surface of the sheet to prevent physical contact between the sheet and the guide surface.

2. A sheet transfer mechanism according to claim 1 with the addition of: side guide means positioned to support edges of a sheet when a central portion of the sheet is adjacent said arcuate guide surface.

3. A sheet transfer mechanism according to claim 1, said means secured to said guide surface to form said chamber comprising a vane, said vane and said arcuate guide surface being configured to form a stream of air directed generally radially in said guide surface.

4. A sheet transfer mechanism according to claim 3, said vane being configured to form a stream of air directed generally perpendicular to the surface of a sheet carried by said gripper means.

5. A sheet transfer mechanism according to claim 1, with the addition of roughened segments on said guide surface to maintain a boundary layer of air adjacent said guide surface.

6. A sheet guide member according to claim 1, said sheet guide member having a plurality of spaced vent openings formed therein which extend through said guide surface such that streams of air from said chamber flow through said guide surface.

* * * * *